US006193063B1

(12) United States Patent
Malkoff

(10) Patent No.: US 6,193,063 B1
(45) Date of Patent: Feb. 27, 2001

(54) GOLF CLUB COVER

(76) Inventor: Abe A. Malkoff, 2482 Barth Dr., Youngstown, OH (US) 44505

( * ) Notice: Subject to any disclaimer, the term of this patent is extended or adjusted under 35 U.S.C. 154(b) by 0 days.

(21) Appl. No.: 09/408,896

(22) Filed: Sep. 29, 1999

Related U.S. Application Data

(63) Continuation-in-part of application No. 09/173,431, filed on Oct. 15, 1998, now abandoned.

(51) Int. Cl.[7] ..... A63B 55/00
(52) U.S. Cl. ..... 206/315.2; 250/160; 473/549
(58) Field of Search ..... 473/549, 301; 150/159, 160; 206/315.2, 315.4

(56) References Cited

U.S. PATENT DOCUMENTS

| | | | |
|---|---|---|---|
| D. 297,448 | 8/1988 | Thawley et al. . | |
| D. 374,051 | 9/1996 | Sheppard, Jr. . | |
| D. 393,893 | 4/1998 | Pollard . | |
| 1,886,464 | 11/1932 | Bright . | |
| 2,014,589 | 9/1935 | Saad . | |
| 2,705,039 | 3/1955 | Halter . | |
| 2,879,819 | 3/1959 | Turnbull . | |
| 3,606,325 * | 9/1971 | Lamkin et al. | 473/549 X |
| 3,965,955 | 6/1976 | Price . | |
| 5,005,624 | 4/1991 | Sung . | |
| 5,145,171 * | 9/1992 | Head et al. | 473/549 X |
| 5,168,909 | 12/1992 | Joyner, Jr. . | |
| 5,284,194 | 2/1994 | Gaffney . | |
| 5,325,986 | 7/1994 | Richardson et al. . | |
| 5,345,987 | 9/1994 | Hagar . | |
| 5,437,320 | 8/1995 | Sung . | |
| 5,547,193 | 8/1996 | Sander . | |
| 5,553,733 | 9/1996 | Rosenthal . | |

* cited by examiner

*Primary Examiner*—Allan N. Shoap
*Assistant Examiner*—Tri M. Mai
(74) *Attorney, Agent, or Firm*—Robert J. Herberger, Esq.

(57) ABSTRACT

A golf club protective cover which provides a semi-rigid upper enclosure to protect the club head and a sock-like lower enclosure attached to the upper enclosure for protection of the club shaft. The upper enclosure is formed as a semi-rigid cylinder and has an elongated opening in the side wall of the upper enclosure so that the club may be inserted into the cover from the top through the elongated opening or through the bottom of the lower enclosure in a conventional manner.

7 Claims, 6 Drawing Sheets

GOLF CLUB COVER

This application is a continuation-in-part of the application having Ser. No. 09/173,431 filed Oct. 15, 1998 now abandoned.

FIELD OF THE INVENTION

This invention relates in general to protective covers for golf clubs and in particular, to such covers which protect the head and shaft of the clubs when they are used during play of the game or are being shipped or stored. This invention also provides a protective cover which allows the club to be inserted into the cover in two separate ways; either from the bottom of the cover or by means of an access opening in the upper portion of the cover.

BACKGROUND OF THE INVENTION

Recent developments in golf club designs have made the protection of golf clubs when not in use more important than in the past. For example, the introduction of the graphite shaft to replace the traditional steel shaft has made protection of the shaft important. When these clubs are in the golf bag and transported during the game, the shafts tend to rub against the edge of the bag or against the partitions in the bag used to separate various groups of clubs. This rubbing on the bag can abrade a "rub ring" on the shaft which first causes cosmetic damage but which can, after time, cause physical damage to the shaft. Also the use of more exotic metals for the club heads, especially the "woods" such as the driver and long fairway clubs, has made protection of the club head equally important.

To provide this protection, long tubular sleeves often referred to as "socks" are known to protect the shafts in the bag and large soft bulbous head covers are attached to the top of the "socks." It is often difficult to thread the club head through this narrow "sock," especially when the head of the club is oversized, which is popular today.

To thread the club head through the narrow tubular sleeve of the "sock," the club shaft is often rested on the ground while the club is held vertical. The head of the club is then threaded through the sock opening into the head cover. However, if the grass is wet or the ground is damp or muddy, the shaft grip, resting on the ground, becomes wet, slippery and/or contaminated with dirt or other abrasives which often interfere with a firm and comfortable grip of the golfer. Also, the moisture and contaminates often accelerate degradation and deterioration of the shaft grip.

Additionally, if the head of the club has acquired soil or other contaminates during use, these abrasive elements can be trapped in the shaft "sock" and will further add to the frictional damage acquired as discussed above.

It would therefore be desirable to have a protective cover for today's golf clubs that could be used to overcome and avoid the noted difficulties.

SUMMARY OF THE INVENTION

The present invention overcomes the difficulties and disadvantages of the prior art by providing a golf club cover which not only protects the shaft and club head but also provides a flexible sleeve member, to protect the shaft, attached to a semi-rigid head cover. The head cover has a reinforced opening in the side wall so that the club may be inserted into the top of the cover. The semi-rigid head cover keeps the side wall opening readily accessible and also provides additional protection from damage by the bag rim or adjacent clubs during play and shipping.

The present invention also comprises a flexible sleeve member with an opening so that the club can be easily removed from the cover by pulling the flexible sleeve portion over the club head, or the cover can be easily placed on the golf club head by sliding the cover down over the club, thereby providing the more standard means of application as an alternative, when weather and course conditions permit.

BRIEF DESCRIPTION OF THE DRAWINGS

Nine figures have been selected to illustrate a preferred embodiment of the present invention.

DETAILED DESCRIPTION OF THE PREFERRED EMBODIMENT

Figure 1:
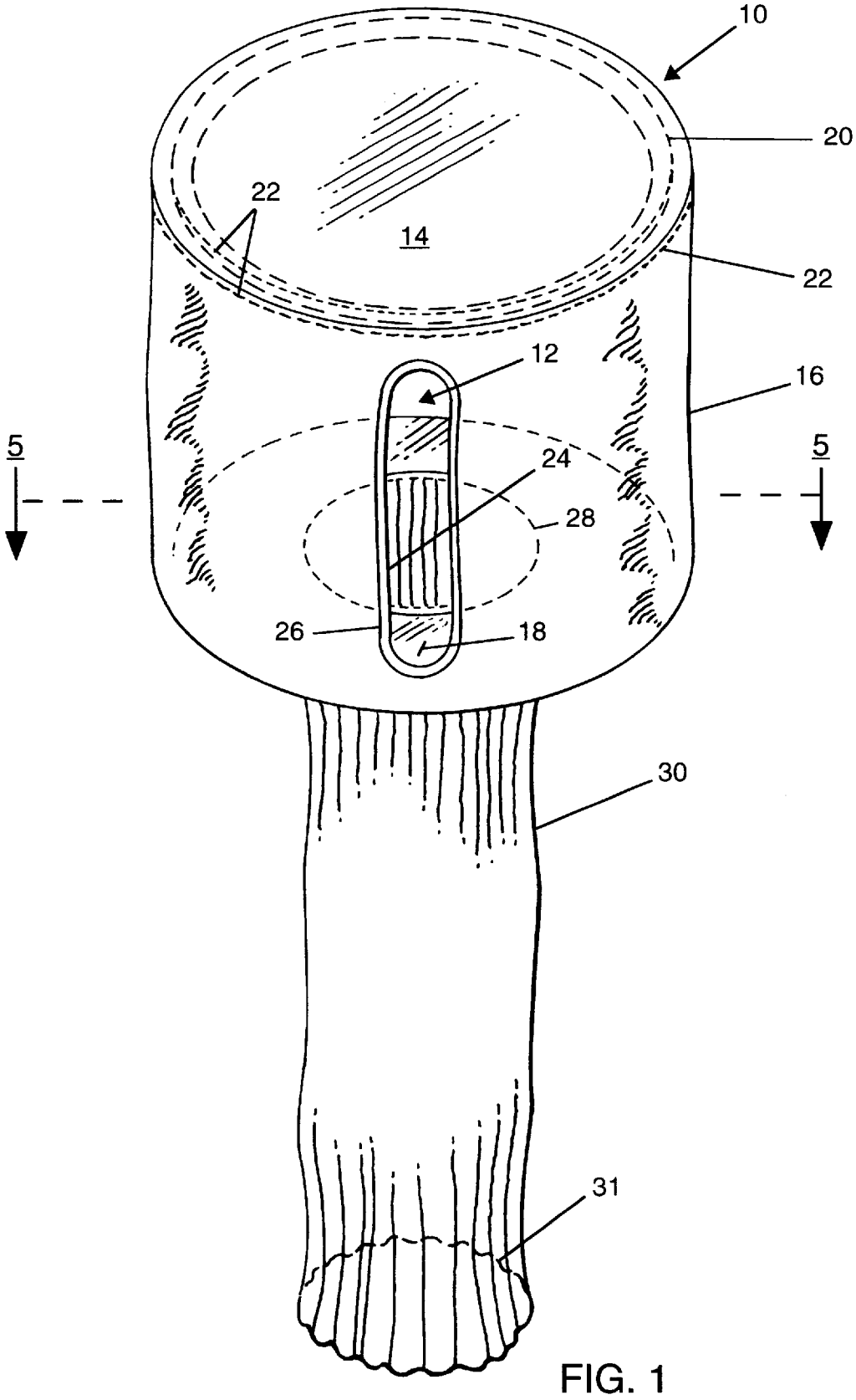
FIG. 1 is a perspective view of the cover of the present invention.
Figure 2:
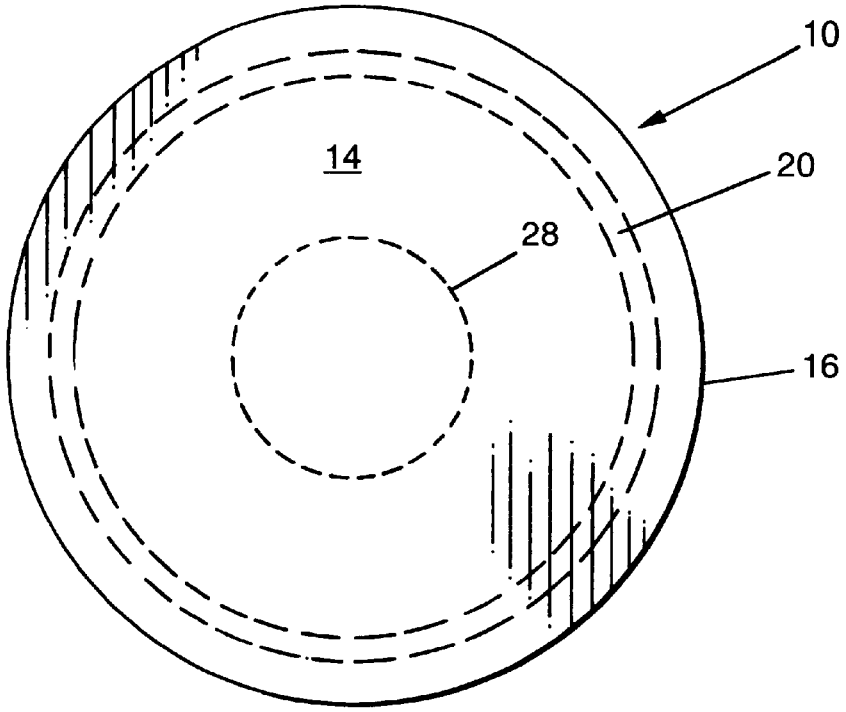
FIG. 2 is a top plan view of the cover.
Figure 3:
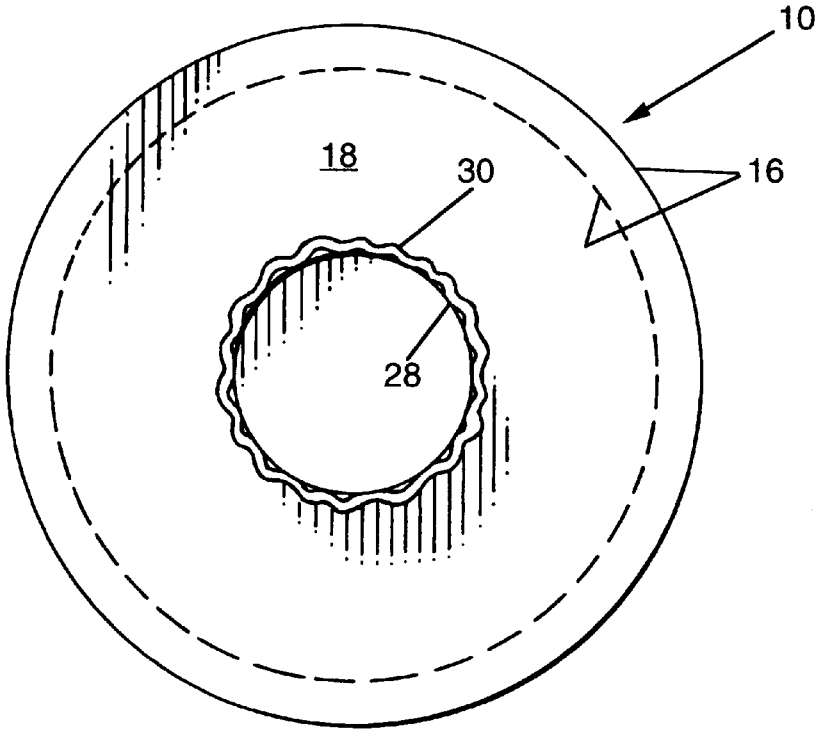
FIG. 3 is a bottom plan view of the cover.
Figure 4:
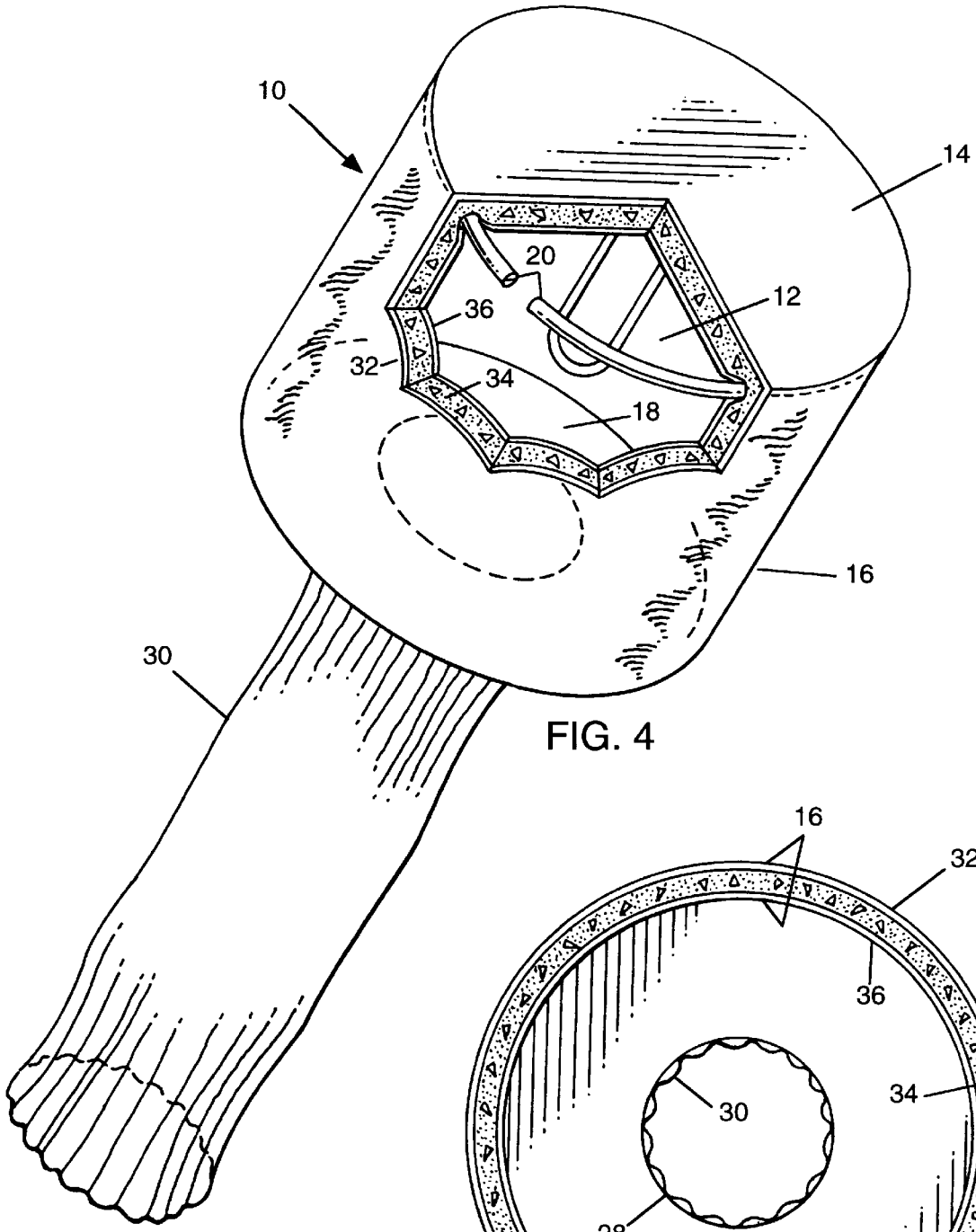
FIG. 4 is a perspective view showing by partial cutaway the wall structure and a circular rigid member.
Figure 5:
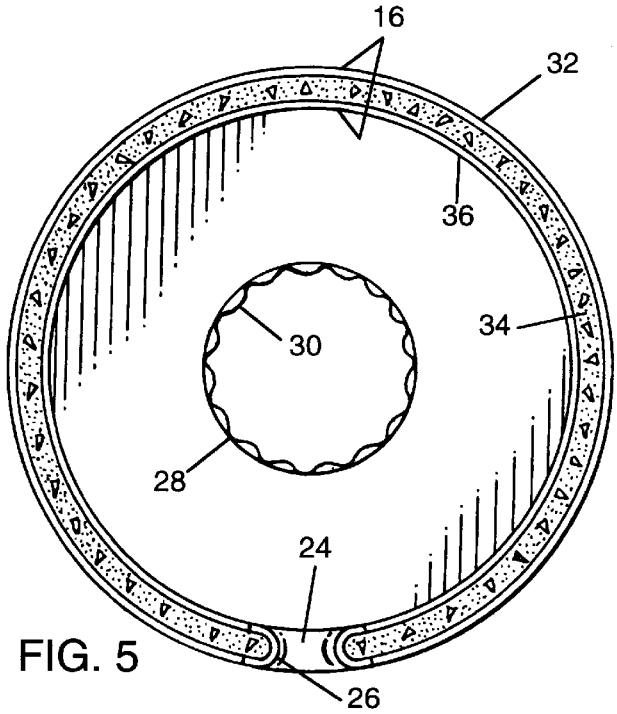
FIG. 5 is a sectional view taken along line 5—5 of FIG. 1.

Referring first to FIG. 1, a perspective view of the cover assembly 10 is shown. An upper enclosure 12 (first enclosure) is formed by a top wall 14, a cylindrical side wall 16 and a bottom wall 18. Around the upper edge of the top wall 14 at the junction with the side wall 16, as best seen in FIG. 4, there is provided a circular rigid member 20 which can be a stiff wire member or similar material to provide rigidity to the assembly. The rigid member 20 is incorporated into a stitching 22, shown in broken lines in FIG. 1, which binds the top wall 14 to the side wall 16. The bottom wall 18 is stitched to the side wall 16 thus forming the cylindrical pocket, or upper enclosure 12, for the club head.

Figure 8:
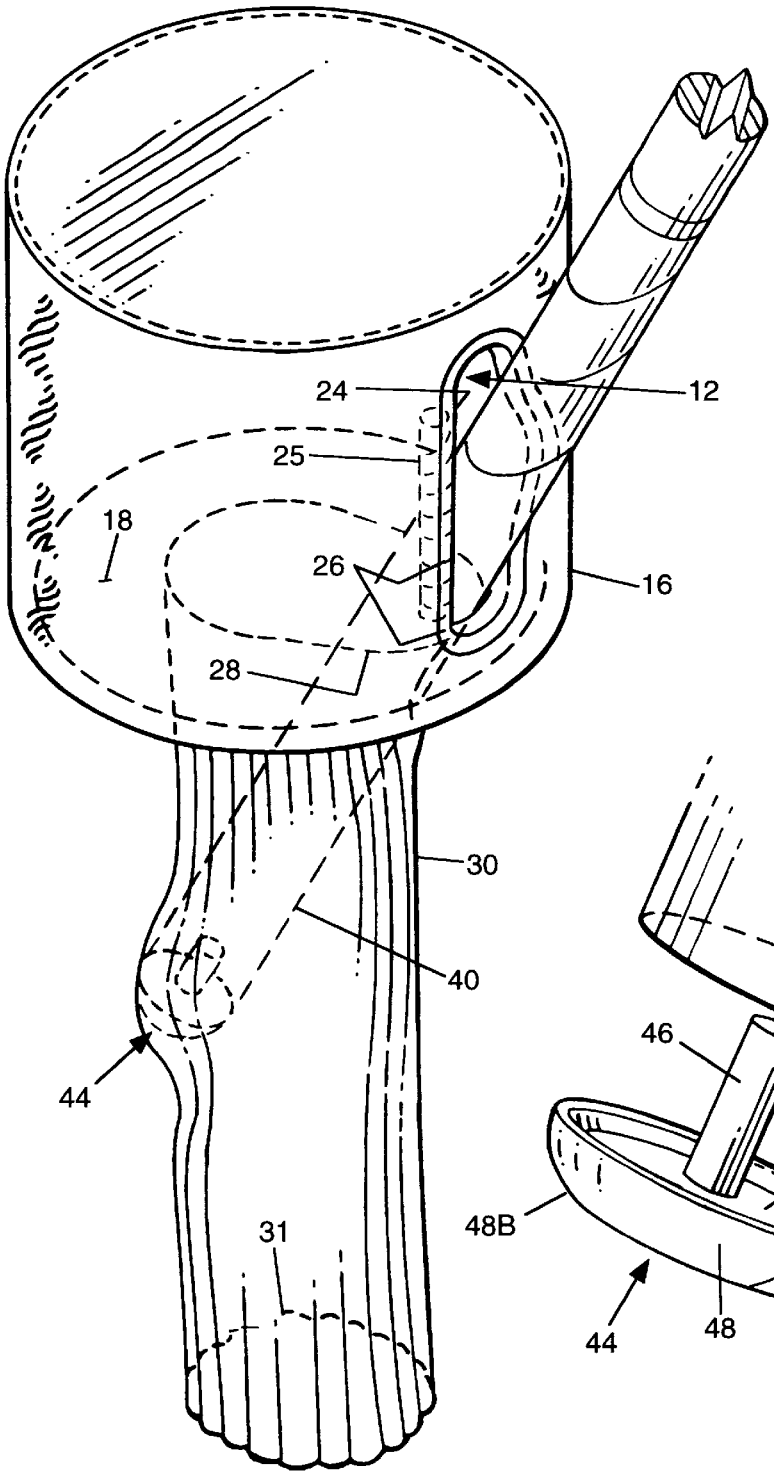
FIG. 8 is a perspective view showing insertion of a shaft of a club into the top of the cover displaying by partial cutaway the reinforcement of the opening in the top of the cover.

In the side wall 16 there is provided an elongated, substantially vertical opening 24 for receiving the distal end of the club shaft 40 when the club is inserted into the cover. Although the length of the opening 24 may vary, in the preferred embodiment, the length is approximately 5 inches to accommodate the various sizes of golf club heads 42. In order to protect the edges of the opening 24 from abrasion damage, a stitch binding 26 is applied around the opening edge. The stitch binding 26 may be elastic to provide additional flexibility, however, elastic binding is not essential. An elongated support member 25 is stitched along one side of the opening 24 to provide firmness, as shown in FIG. 8, so that the opening 24 remains permanently elongated for easier access of the club in and out of the cover 10. The elongated support member 25 is preferably a flexible plastic, although it may be metal. Since the material of the side wall 16, elongated support member 25 and stitch binding 26 is elastic and/or flexible, the opening 24 can be pulled open, then stretched via the elastic and unreinforced side of the opening, which is opposite the side of the opening 24 having the elongated support member 25, to admit the club head 42 into the pocket 12. The bottom wall 18 is provided with a stretchable central opening 28 for receiving one end of a lower enclosure 30 (second enclosure).

The lower enclosure 30 is made of a flexible and elastic material and forms a sock-like enclosure for a portion of the club shaft. In the preferred embodiment, the flexible material used to form the lower enclosure 30 is knitted and attaches directly to the bottom portion of cylindrical side wall 16. Due to the elasticity of said knitted material, the material substantially contracts inward thereby forming bottom wall 18 and central opening 28, which then leads into lower enclosure 30. The opposite end of the lower enclosure 30 has a stretchable opening 31. As an alternative design, an end of the lower enclosure 30 is attached by stitching, or other known fastening means, to the bottom wall 18 at the central opening 28. In the alternative design, bottom wall 18 attached to side wall 16 is a flexible material separate from the knitted material forming lower enclosure 30.

Referring now to FIG. 4, there is shown in a partial cutaway view, the details of construction of the upper enclosure 12. The walls 14 and 16 are comprised of a three layer assembly. An outer layer 32 is selected for a pleasing appearance and may, for example, be of a synthetic fur material, preferably waterproof. A center layer 34 is a reinforcing layer made of foam or similar material and contributes to the rigidity of the cover. An inner layer 36 is of a soft, elastic cloth material chosen to protect the finish of the club head 42 during storage. As discussed above, there is provided at the junction of the top wall 14 and the side wall 16, the rigid member 20 being a stiffening wire. This wire, in combination with the reinforcing layer 34, maintain the upper enclosure 12 in a semi-rigid cylindrical form.

Figure 6:
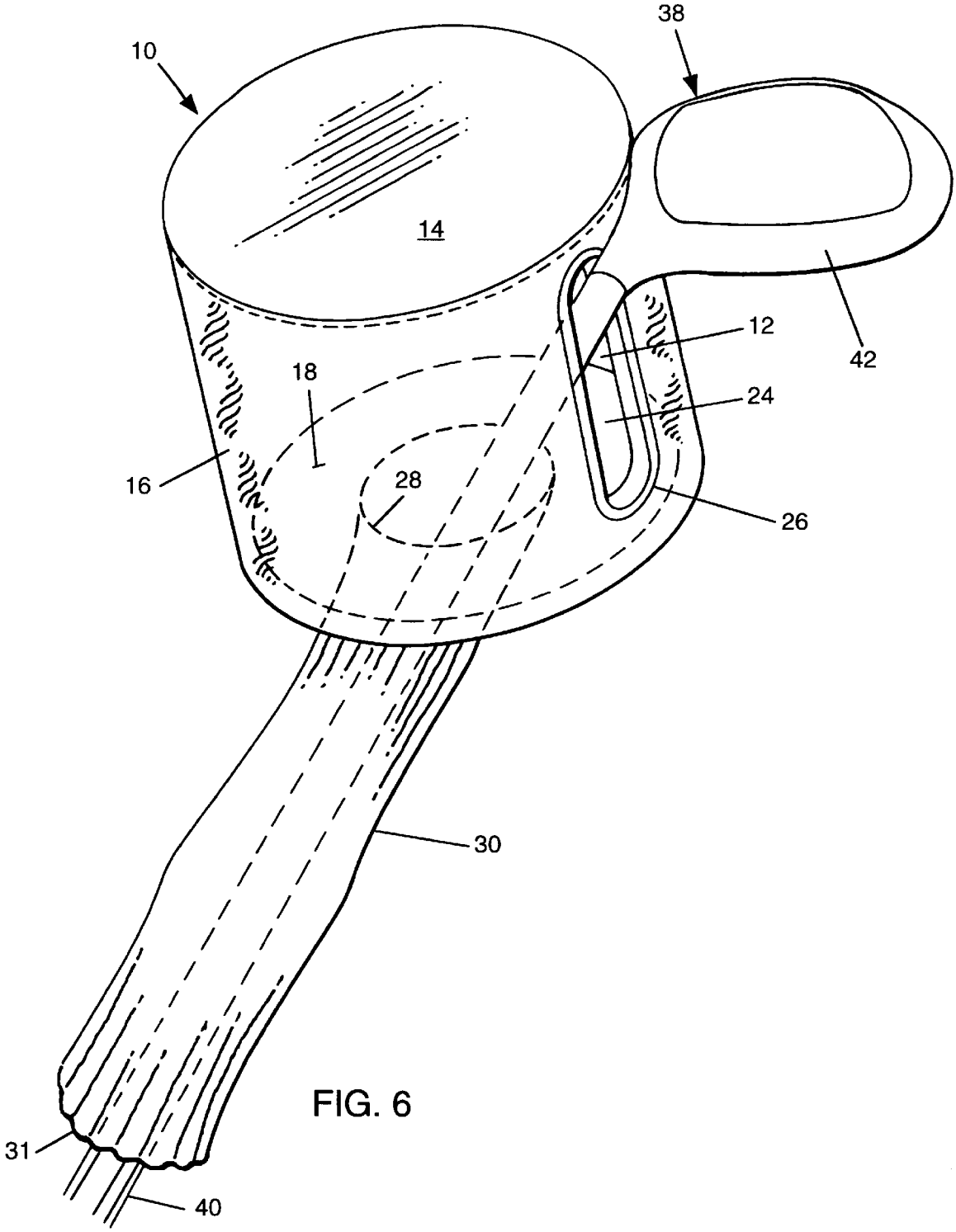
FIG. 6 is a perspective view showing insertion of a club into the top of the cover.
Figure 7:
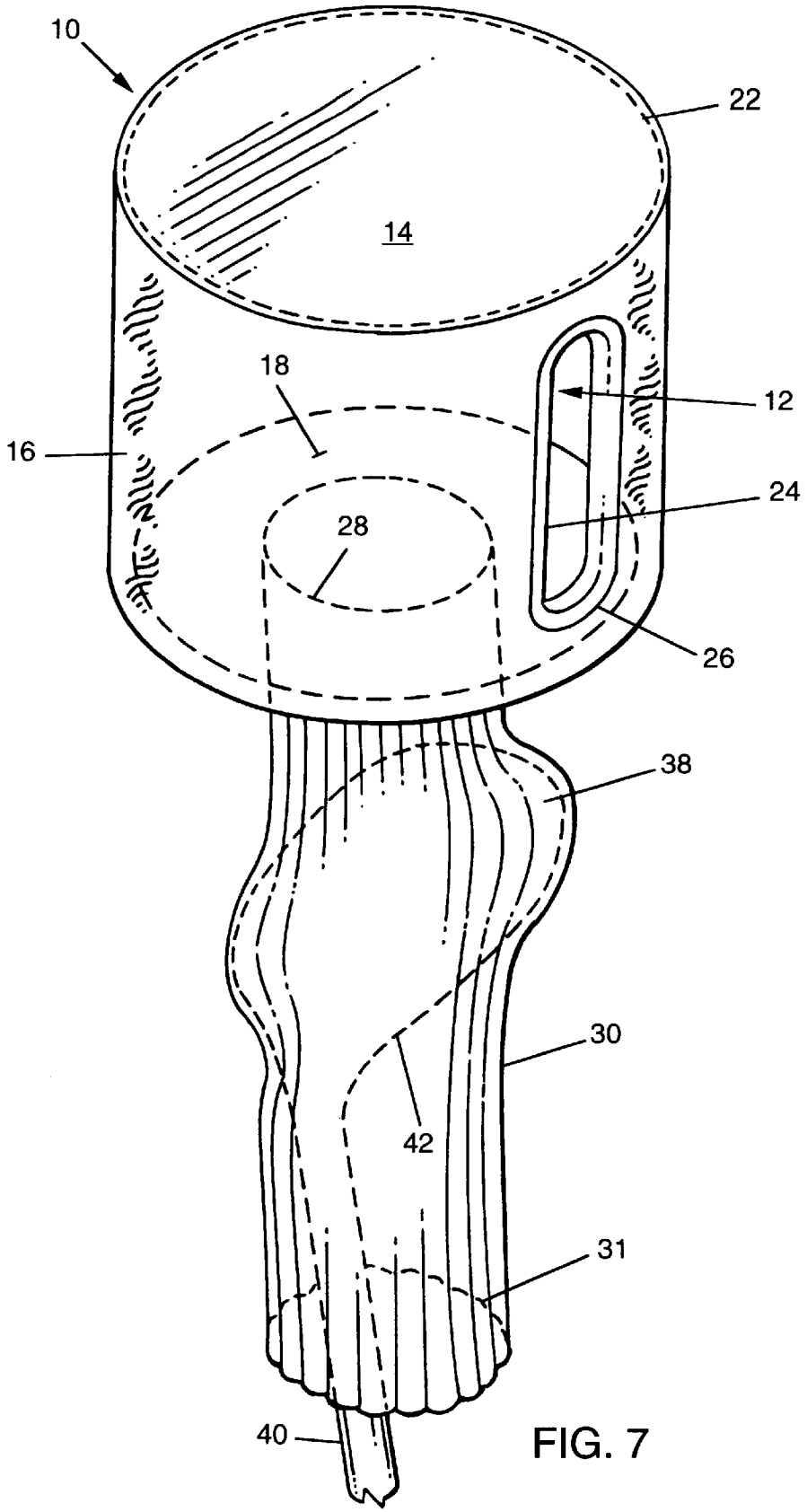
FIG. 7 is a perspective view showing removal of a golf club through the bottom of the sleeve.

FIGS. 6, 7 and 8 illustrate the ways in which the invention may be used. In FIG. 6, the golf club 38 is shown being inserted into the cover 10 through the upper enclosure 12. In this mode, the distal end of the club shaft 40 is inserted into the opening 24 and then through the stretchable hole 28 in the bottom wall 18 of the upper enclosure 12. The shaft then is slipped through the lower enclosure 30 and the club head 42 is pushed through the flexible and stretchable opening 24 into the pocket 12. In FIG. 7, insertion or removal of the golf club from the open end of the lower enclosure is demonstrated. Here, for insertion for example, the club head 42 is inserted into the bottom opening 31 of the lower enclosure 30. The club head 42 is then pushed through the lower stretchable opening 28 into the bottom wall 18 and up into the pocket 12 in the conventional manner. The club head is removed through the lower enclosure 30 in reverse fashion.

Figure 9:
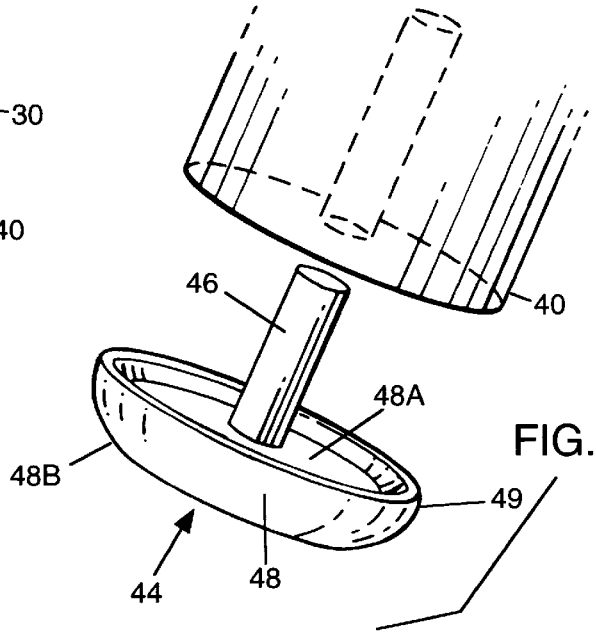
FIG. 9 is perspective exploded view of a shaft end-cap attached at the distal end of the golf club shaft.

More specifically describing the mode of use whereby the distal end of the shaft 40 is inserted into the cover through the upper enclosure 12, an end-cap 44 shown in FIG. 9 is inserted in the distal end of the shaft 40 to protect the shaft but, more importantly, to reduce friction when the club shaft 40 is inserted through opening 24 and then through the lower enclosure 30. The end-cap 44 has a cylindrical stem 46 having a diameter slightly larger than the diameter of an opening common at the distal end of the club shaft 40. The preferred length and diameter of the cylindrical stem 46 is 19 mm and 3 mm, respectfully. Referring to FIGS. 8 and 9, the end-cap 44 is attached to the distal end of the club shaft 40 at a concave inner side 48A of an end-disk 48. The concaved shape of the end-disk 48 allows for a close fit of the end-cap 44 over the distal end of the golf club shaft 40. The outer surface 48B of the end-disk 48 has an outermost preferred diameter of 28 mm so that it slightly overlaps, passes around and over the top of the shaft's distal end via a rounded edge 49. The top of the outer surface 48B is flat and smooth and the rounded edge 49 of the end-disk 48 is also relatively unabrasive. The rounded edge 49 makes a smooth and more gradual transition between the top of the outer surface 48B of the end cap 44 and the side of the distal end of the club shaft 40, as opposed to the sharper turned edge of a typical club. Without the end-cap, it was found that the shaft of the club often snagged the elastic material. The end cap 44 is therefore needed to protect the cover, especially the bottom wall 18 of the upper enclosure 12 and the knitted, elastic sock-like lower enclosure 30, from being snagged, stretched and ripped by the distal end of the club shaft 40. Also, the shaft 40 of the golf club can stress, become distorted, and possibly break, if snagged aggressively. The end cap 44 also serves to protect the distal end of the club shaft 40 from dirt and moisture.

Thus it can be seen that the present invention described above provides a unique cover for a modern golf club which provides a semi-rigid enclosure for the club head as well as a soft protective sleeve and end cap for the fragile shaft. It also provides a unique feature which allows the club to be inserted into the cover through the top end without snagging and removed from the cover through the sleeve, thereby preventing contact by the club, and more specifically the hand-grip of the club shaft, with the ground.

What is claimed is:

1. In combination, a golf club cover for protecting the head and shaft of a golf club, said cover comprising:

a first enclosure for receiving the head of a golf club said first enclosure comprising a multi-layer construction including a soft elastic material and a semi-rigid foam material, said first enclosure further having a top wall, a side wall attached to said top wall forming said first enclosure into a generally cylindrical enclosure, said first enclosure having a seam junction between said top wall and said side wall, a reinforcing member being along said seam junction and serving to make said first enclosure a semi-rigid structure, said side wall having a generally elongated opening therein for inserting therethrough the shaft of the golf club and finally the head of the golf club into said first enclosure, the opening having an outer edge with a stretchable binding, the opening is stretchable to admit the head of the golf club and naturally closed when the head of the golf club is not being passed therethrough;

means defining a second enclosure for receiving the shaft of the golf club, said means defining said second enclosure comprising a flexible and elastic sleeve attached at one end to the side wall of said first enclosure and open at the other end for passage therethrough the head and shaft of the golf club from said cover; and an end cap to attach to said golf club shaft, said end cap having a smooth outer surface with a rounded edge so that the club may be inserted into the cover without substantially snagging the elastic sleeve of the means defining the second enclosure.

2. The combination according to claim 1, wherein the elongated stretchable opening in said first enclosure is narrow having an elongated and flexible support member attached to a portion of the outer edge keeping the opening elongated.

3. In combination, a golf club cover for protecting the head and shaft of a golf club comprising:

a first enclosure for receiving the head of the golf club, said first enclosure having a top wall, a side wall attached at said top wall forming said first enclosure into a generally cylindrical enclosure, said first enclosure is semi-rigid with a seam junction between said top wall and said side wall, said side wall of the first enclosure comprises a multi-layered construction, including an outer layer, a center layer and an inner layer, said center layer being of a semi-rigid foam material, said side wall having an opening therein for inserting therethrough the shaft of the golf club and finally the head of the golf club into said first enclosure, said opening being elongated and having at least two sides, one side of the opening having an elongated and flexible support member to cause the opening to substantially retain the elongated shape, the other side of the opening being stretchable, the opening is naturally closed when the head of the golf club is positioned in the first enclosure;

a rigid reinforcing member being attached in the first enclosure, said reinforcing member being ring-shaped and positioned along said seam-junction of said top wall and said side wall, said reinforcing member serving to make said first enclosure a semi-rigid structure;

a second enclosure for receiving the shaft of the golf club, said second enclosure comprising an elongated flexible and elastic sleeve extending at one end from said first enclosure and open at the opposite end of the second enclosure for passage therethrough the head and shaft of the golf club from said cover; and an end cap to firmly attach at the distal end of the golf club shaft, said end cap having a concave inner surface and a substantially smooth outer surface with a rounded edge so that the club shaft may be inserted into the cover without substantially snagging the elastic sleeve of the second enclosure.

4. The combination according to claim 3, wherein the stretchable opening in said first enclosure is longitudinally elongated and narrow having a protective edge comprising an elastic binding.

5. The combination according to claim 3, wherein said outer and inner layers having a soft elastic material.

6. In combination, a golf club cover protecting the head and shaft of a golf club, said cover comprising:

a first enclosure for receiving the head of the golf club, said first enclosure being cylindrical, said first enclosure having a top wall and a side wall attached thereto, said side wall of said first enclosure having a cylindrical shape, and the side wall and top wall having a multilayered construction, including a soft elastic material and a semi-rigid foam material, an elongated and stretchable opening in the side wall for inserting therethrough the shaft of the golf club and finally the head of the golf club into said first enclosure, the opening having an outer edge with at least two sides, said elongated and stretchable opening in said first enclosure is narrow, one of said sides of said opening having a flexible support member to maintain the opening substantially elongated and the second side of said opening having a stretchable binding at the opening edge, said elongated opening can be flexed and stretched to admit the head of the golf club and substantially closes naturally when the head of the golf club is positioned in the first enclosure;

a second enclosure for receiving the shaft of the golf club, said second enclosure comprising an elongated flexible and elastic sleeve extending at one end from the side wall of the first enclosure and having an opening at the opposite end for removing therethrough the head and shaft of the golf club from said cover; and an end cap having a concave inner portion and rounded outer portion, the concave inner portion fitting against the distal end of the shaft of said golf club, the outer portion of the end cap being smooth and having a rounded edge so that the club may be inserted into the cover without substantially snagging the elastic sleeve of the second enclosure.

7. The combination according to claim 6, wherein the first enclosure further comprising a rigid reinforcing member, said rigid reinforcing member is substantially round.

* * * * *